US009803633B2

(12) United States Patent
Chou

(10) Patent No.: US 9,803,633 B2
(45) Date of Patent: Oct. 31, 2017

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 294 days.

(21) Appl. No.: 14/686,747

(22) Filed: Apr. 14, 2015

(65) Prior Publication Data

US 2015/0300343 A1 Oct. 22, 2015

(30) Foreign Application Priority Data

Apr. 22, 2014 (TW) ..... 103114590 A

(51) Int. Cl.

| | |
|---|---|
| ***F04B 35/04*** | (2006.01) |
| ***F04B 41/02*** | (2006.01) |
| ***F04B 39/10*** | (2006.01) |
| ***F04B 39/12*** | (2006.01) |
| ***F04B 39/14*** | (2006.01) |
| ***F04B 35/01*** | (2006.01) |
| ***F04B 53/14*** | (2006.01) |

(52) U.S. Cl.

CPC ..... *F04B 41/02* (2013.01); *F04B 35/01* (2013.01); *F04B 39/10* (2013.01); *F04B 39/121* (2013.01); *F04B 39/123* (2013.01); *F04B 39/14* (2013.01); *F04B 53/14* (2013.01); *F04B 35/04* (2013.01)

(58) Field of Classification Search

CPC ..... F04B 35/04; F04B 39/066; F04B 39/125; F04B 39/127

See application file for complete search history.

(56) References Cited

U.S. PATENT DOCUMENTS 8,297,944 B2 * 10/2012 Chou ..... F04B 35/008 285/33

* cited by examiner

*Primary Examiner* — Patrick Hamo

(57) ABSTRACT

An air compressor includes an air storage unit defining a first chamber and a cylinder containing a piston body. The top wall of the cylinder is formed with a tubular projection defining a bore to serve as a second pressure chamber. When the piston head of the piston body is almost in contact with the top wall of the cylinder, part of the compressed air can enter the second pressure chamber, so that the piston body can conduct reciprocation motion more smoothly. Furthermore, the cylinder has an open bottom that is divided into two halves according to a central vertical line of the cylinder, wherein one half of the open bottom is horizontal while the other half of the open bottom is slanted. When the piston body is at BDC, the piston head will be entirely within the cylinder and thus keep gas-tight with the cylinder.

12 Claims, 11 Drawing Sheets

AIR COMPRESSOR

(a) TECHNICAL FIELD OF THE INVENTION

The present invention relates to an air compressor and, more particular, to an air compressor that includes an air storage unit and a cylinder fitted with a piston body to conduct reciprocating motion for producing compressed air, wherein the air storage unit defines a first pressure chamber, and the top wall of the cylinder is formed with a tubular projection that defines a bore to serve as a second pressure chamber, whereby when the piston head of the piston body is almost in contact with the top wall of the cylinder, part of the compressed air can enter the second pressure chamber, so that the downward motion of the piston body can be conducted more smoothly; and further wherein the cylinder has an open bottom that is divided into two halves according to a central vertical line of the cylinder, one half of the open bottom being horizontal while the other half of the open bottom being slanted, whereby when the piston body is at BDC (bottom dead center), the piston head will be entirely within the open bottom of the cylinder and thus cannot escape from the cylinder, so that the operation security can be increased, and the piston head can keep gas-tight with the inner surface of the surround wall of the cylinder, so that the performance of compressing air can be increased.

(b) DESCRIPTION OF THE PRIOR ART

Generally, an air compressor employs a motor to drive a piston to conduct reciprocating motion within a cylinder. The air being compressed by the piston can enter an air storage unit via a hole at the top wall of the cylinder. The air storage unit has one or more connection fittings, which can be installed with functional elements, such as a safety valve or relief valve, or connected with a hose to allow the compressed air to be delivered to an application object, such as a gas nozzle of a tire.

In conventional air compressors, the thickness of the top wall of the cylinder is approximately equal to the thickness of the surrounding wall of cylinder. When the piston reaches TDC (top dead center), the piston is almost in contact with the top wall of the cylinder. Therefore, the compression stroke will force the compressed air in the inner space of the cylinder to totally enter an air storage unit communicating with the inner space of the cylinder, from which the compressed air can be delivered for various applications, such as inflating a tire. The pressure of the compressed air produced in this kind of compressor often exceeds the pressure required for a tire to be inflated. Besides, the excessively high pressure of air can hinder the piston to conduct reciprocating motion, and thus the performance of compressing air can be reduced.

The applicant has been dedicated to developing air compressors for a long time. At the early days, the applicant successfully converted a complicated air compressor into an air compressor that is simple in structure and can be quickly assembled. The applicant also successfully modified a conventional air compressor to increase its performance.

In view of the disadvantages of the above conventional air compressor, based on long-term experiences of related compressor products, the applicant has contrived an improved air compressor, which employs the bore of a tubular projection formed on the top wall of the cylinder as a second pressure chamber, so that when the piston is almost in contact with the top wall of the cylinder, part of the compressed air can enter the second pressure chamber, thereby facilitating the following downward motion. Furthermore, one half of the open bottom of the cylinder is configured with a slope so that when the piston is at BDC, the piston head is entirely within the open bottom of the cylinder and thus will not escape from the cylinder, so that the operational security can be increased and the piston head can keep gas-tight with the cylinder, thereby increasing the performance of compressing air.

SUMMARY OF THE INVENTION

One object of the present invention is to provide an air compressor that includes an air storage unit and a cylinder fitted with a piston body for conducting reciprocating motion, wherein the air storage unit defines a first pressure chamber, the cylinder is formed integrally with a main housing that mounts a motor, and a tubular projection is formed on the top wall of the cylinder, the bore of the tubular projection communicating with the inner space of the cylinder and being able to serve as a second pressure chamber for storing compressed air.

Another object of the present invention is to provide an air compressor, wherein the cylinder has an open bottom that is divided into two halves according to a central vertical line of the cylinder, wherein one half of the open bottom is horizontal, while the other half of the open bottom is slanted.

A further object of the present invention is to provide an air compressor, wherein the air storage unit is a storage cylinder formed integrally with the cylinder.

A still further object of the present invention is to provide an air compressor, wherein the air storage unit is a separate storage cylinder that is detachably mounted to the cylinder.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
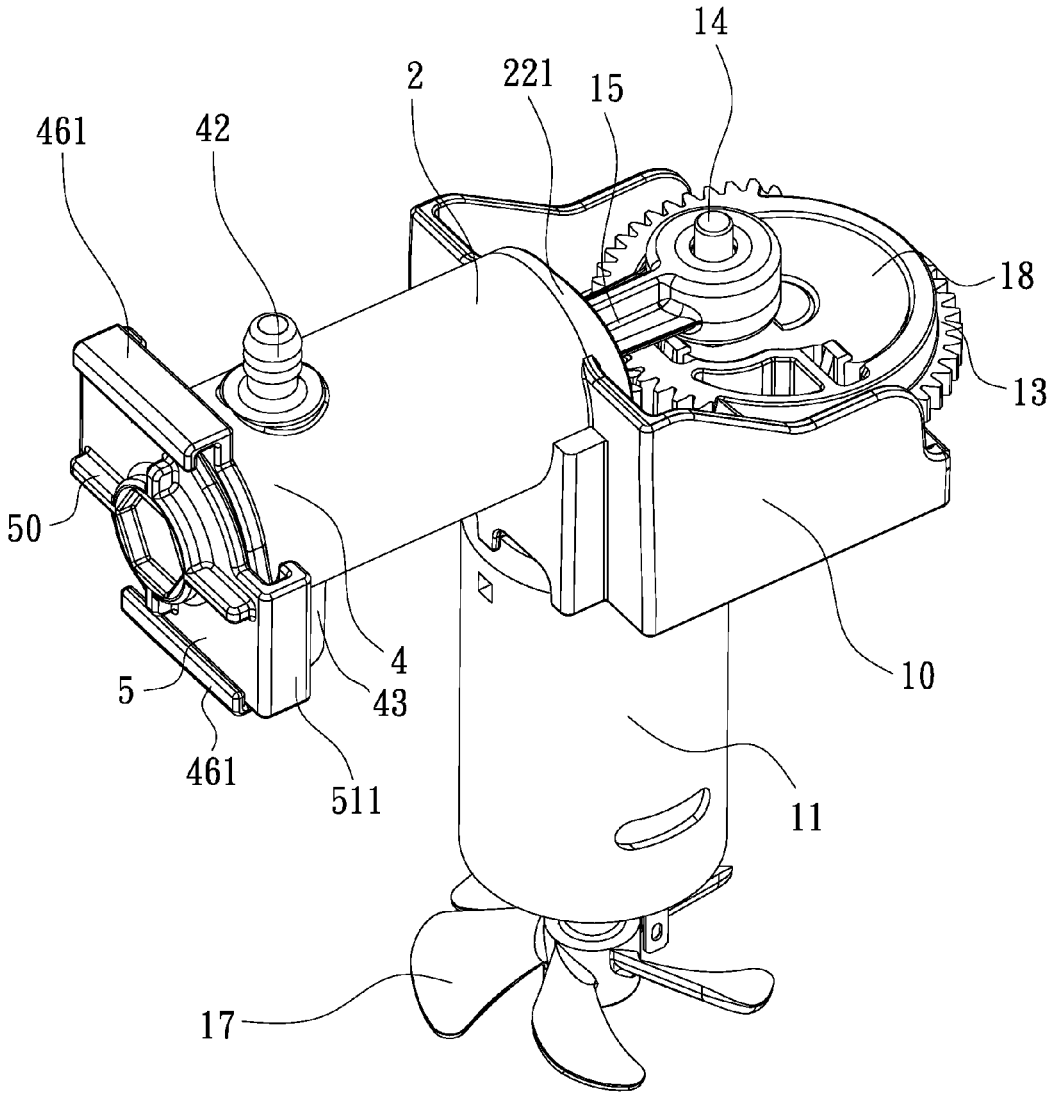
FIG. 1 shows a 3-dimensional view of an air compressor according to a first embodiment of the present invention.
Figure 2:
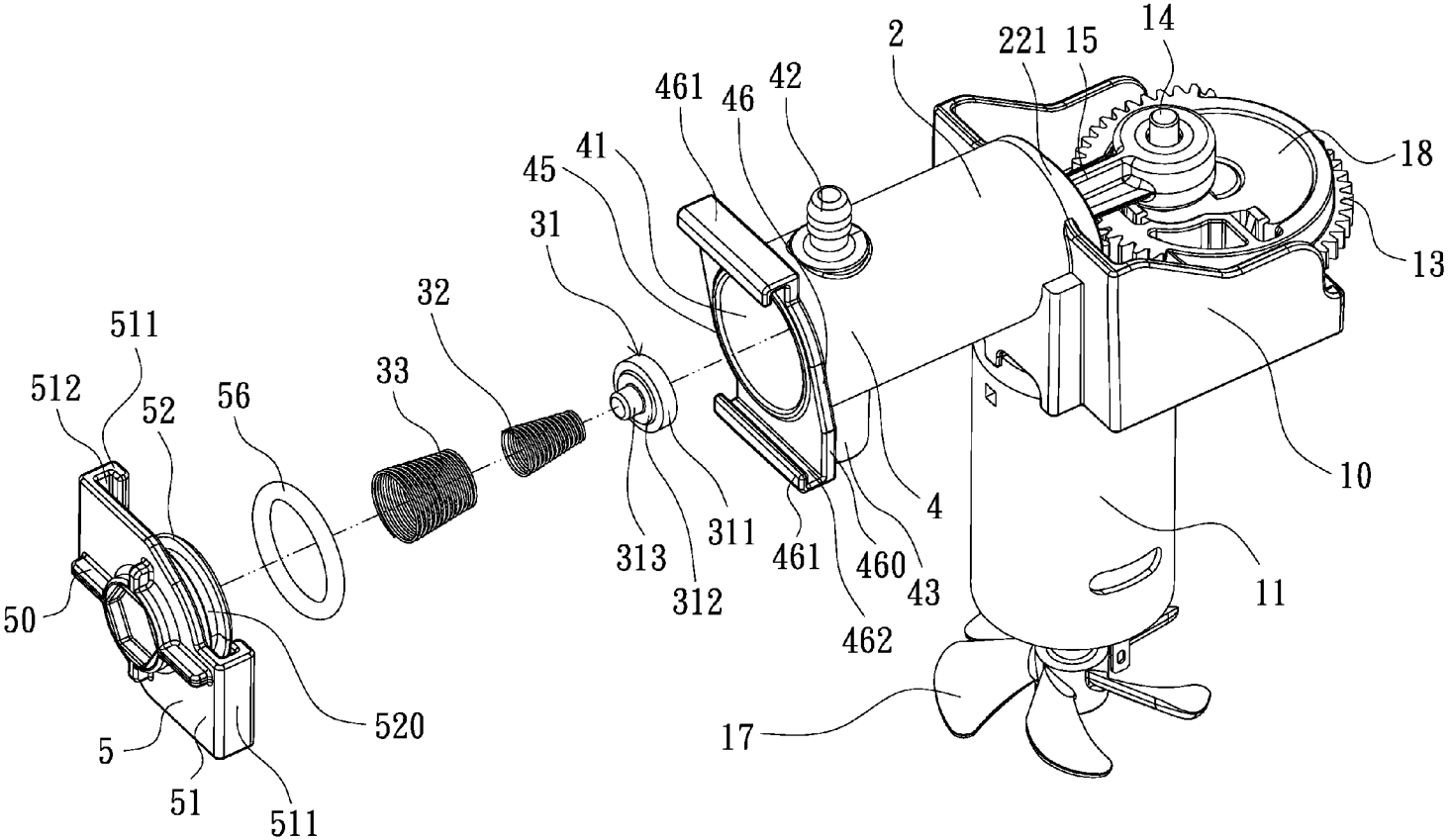
FIG. 2 shows an exploded view of the air compressor of the first embodiment of the present invention.
Figure 3:
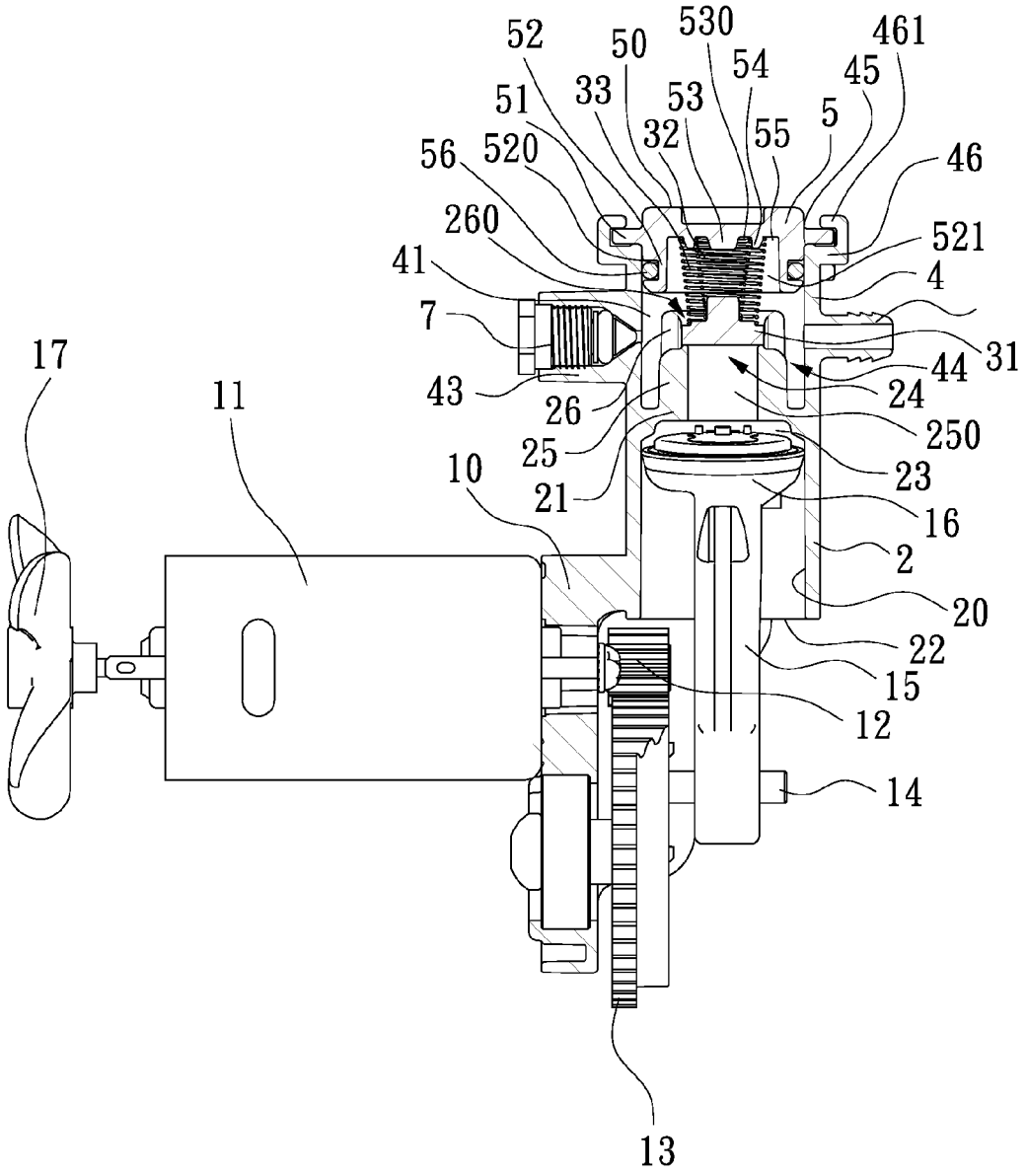
FIG. 3 shows a sectional view of the air compressor of the first embodiment of the present invention.

Referring to FIGS. 1, 2 and 3, an air compressor according to a first embodiment of the present invention is shown, wherein the cylinder 2, being fitted with a piston body 15, is joined or formed integrally with the main housing 10. The main housing 10 can mount a power mechanism, which includes a motor 11, a small gear 12, a large gear 13 engaged with the small gear 12, a counterweight 18 provided on the large gear 13 and fixed with a crankpin 14, and a cooling fan 17. The motor 11 can drive the crankpin 14 to swing in a circle, via the small gear 12 and the large gear 13, which allows the piston body 15 to conduct reciprocating motion within the cylinder 2. The piston body 15 contains a piston head 16 being integrally formed therewith. As such, the compressed air in the inner space 23 of the cylinder 2 can go through a bore 250 and overcome the biasing force of the compression springs 32, 33 to push a valve plug 31 to move up, so that the compressed air can enter a storage cylinder 4 being provided with multiple connection fittings 42, 43, wherein the connection fitting 42 can be connected with a hose (not shown), while the connection fitting 43 is installed with a safety valve 7. The following paragraphs will illustrate the features of the present invention in more detail.

Figure 6:
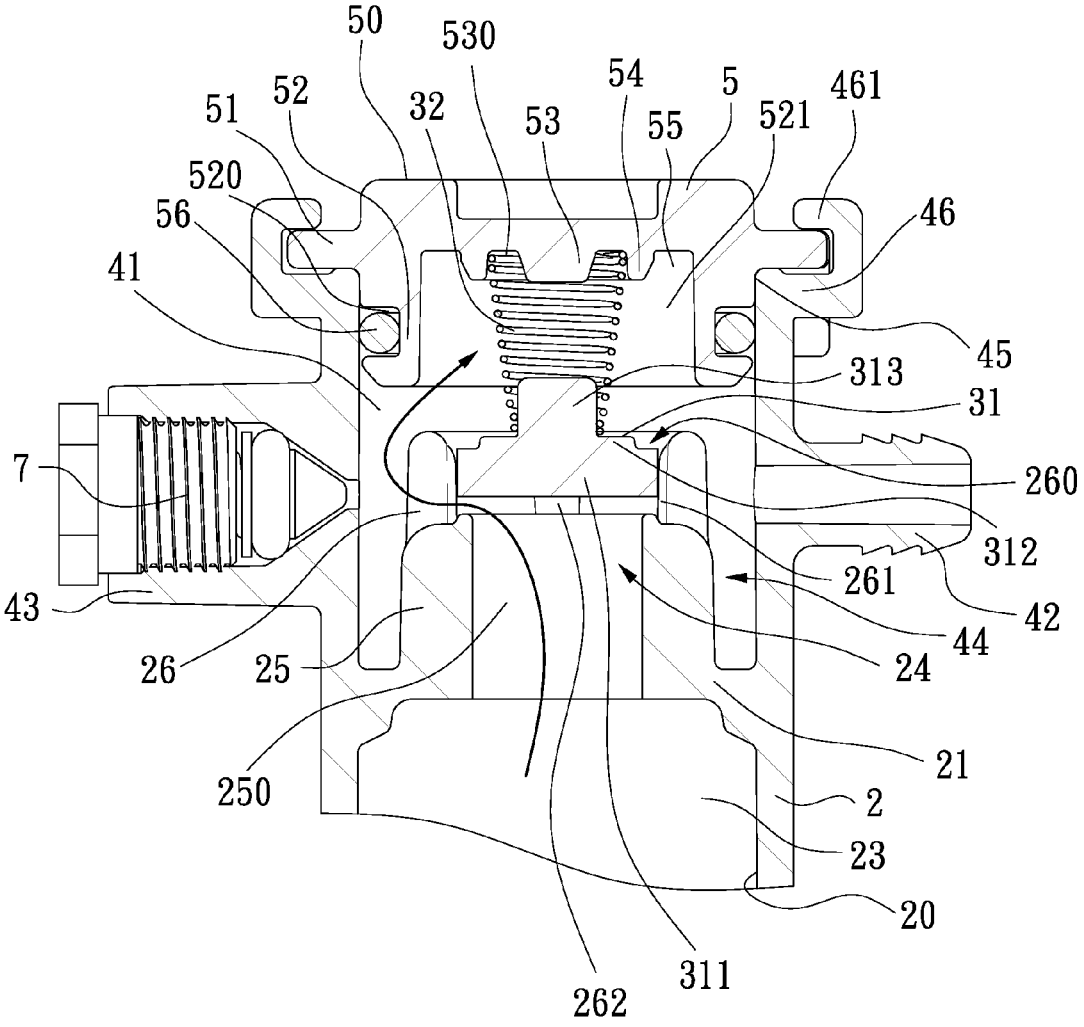
FIG. 6 shows an enlarged partial view of the air compressor of the first embodiment of the present invention, wherein only one compression spring is installed.

The cylinder 2 has a top wall 21 and an open bottom 22. A tubular projection 25 is formed on the top wall 21. The bore 250 of the tubular projection 25 communicates with the inner space 23 of the cylinder 2. The top of the tubular projection 25 is provided with multiple tabs 26 at regular gaps 262 and defines a central space 260 therebetween (see also FIG. 6). The inner surface of each tab 26 is formed with multiple spaced ribs 261. The valve plug 31 is formed by three coaxial round portions of different diameters, including a bottom round portion 311, a middle round portion 312, and a top round portion 313, wherein the bottom round portion 311 has a diameter greater than the middle round portion 312, and the middle round portion 312 has a diameter greater than the top round portion 313. The valve plug 31 is placed in the central space 260 surrounded by the tabs 26 and snugly fitted between the ribs 261 of the tabs 26, so that the valve plug 31 can be prevented from lateral movement upon a force. One or more compression springs with suitable elasticity coefficients can be used for biasing the valve plug 31. As shown in FIGS. 3 and 6, one end of the compression spring 32 with smaller diameter can be fitted around the top round portion 313 while urged against the middle round portion 312. Alternatively, one end of the compression spring 33 with greater diameter can be fitted around the middle round portion 312 while urged against the bottom round portion 311. Either the compression spring 32 or the compression spring 33 can be used to bias the valve plug 31 so as to control the compressed air of the cylinder 2 entering the first pressure chamber 44. Of course, the two compression springs 32, 33 can be used simultaneously to bias the valve plug 31 for controlling the compressed air. Specifically, the diameter of the bottom round portion 311 is smaller than the diameter of the central space 260 surrounded by the tabs 26 but greater than the diameter of the bore 250 of the tubular projection 25. Thus, the compressed air can be controlled by the valve plug 31 to flow through the bore 250 of the tubular projection 25 and the gaps 262 between the tabs 26 to enter the inner space 41 of the storage cylinder 4, which constitute part of the first pressure chamber 44. Furthermore, the length of the bore 250 of the tubular projection 25 is greater than the height of the valve plug 31. Therefore, the bore 250 of the tubular projection 25 can serve as a second pressure chamber 24 effectively.

Preferably, the top surface of the piston head 16 is configured with a slope. With such feature, the force required for moving the piston body 15 at BDC (bottom dead center) or TDC (top dead center) can be reduced, and the gas-tightness between the piston head 16 and the cylinder 2 can be increased after the piston body 15 passes BDC or TDC, so that the reciprocating motion of the piston body 15 can be conducted more smoothly and the performance of compressing air can be increased.

Figure 4:
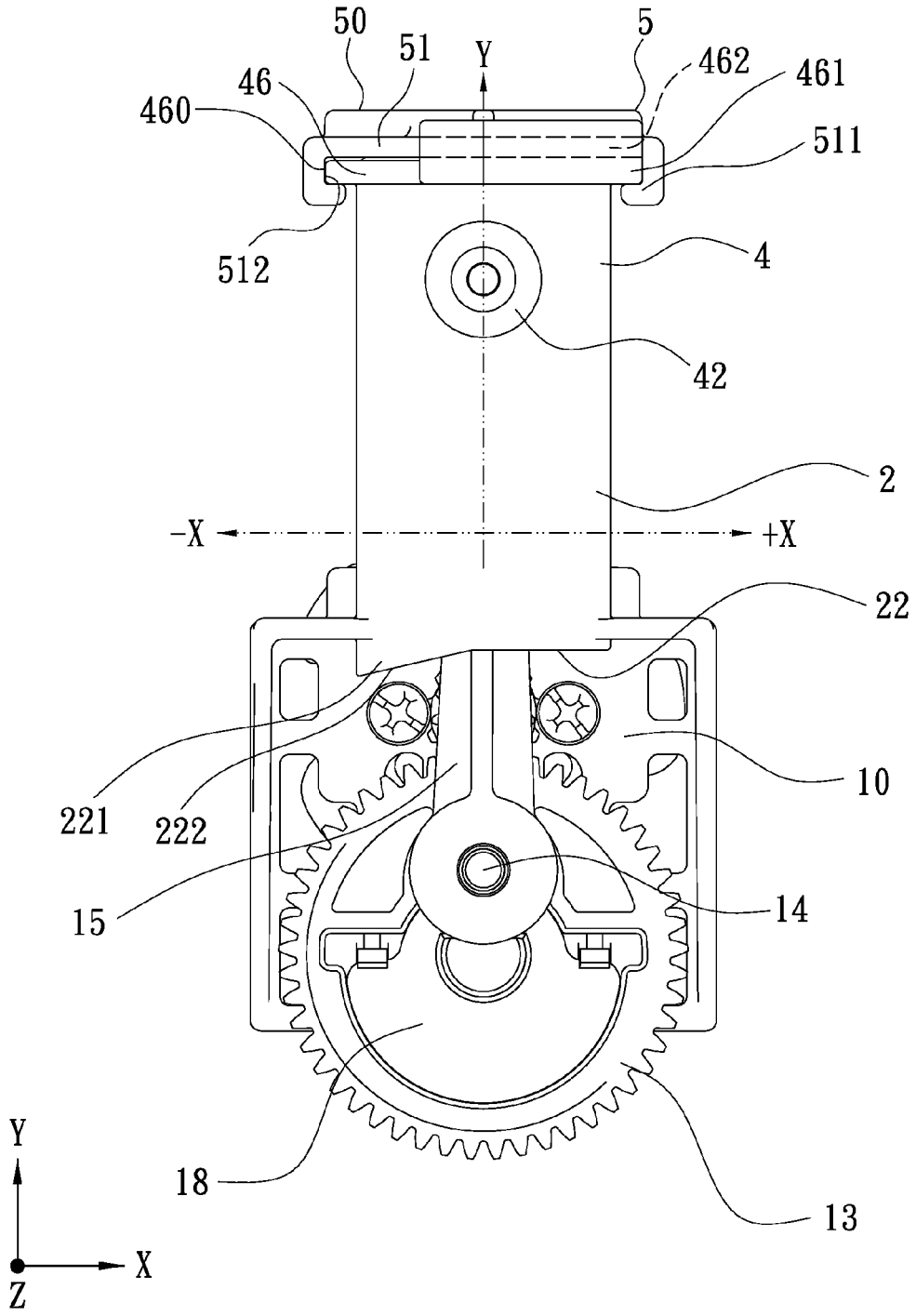
FIG. 4 shows a front view of the air compressor of the first embodiment of the present invention.
Figure 5:
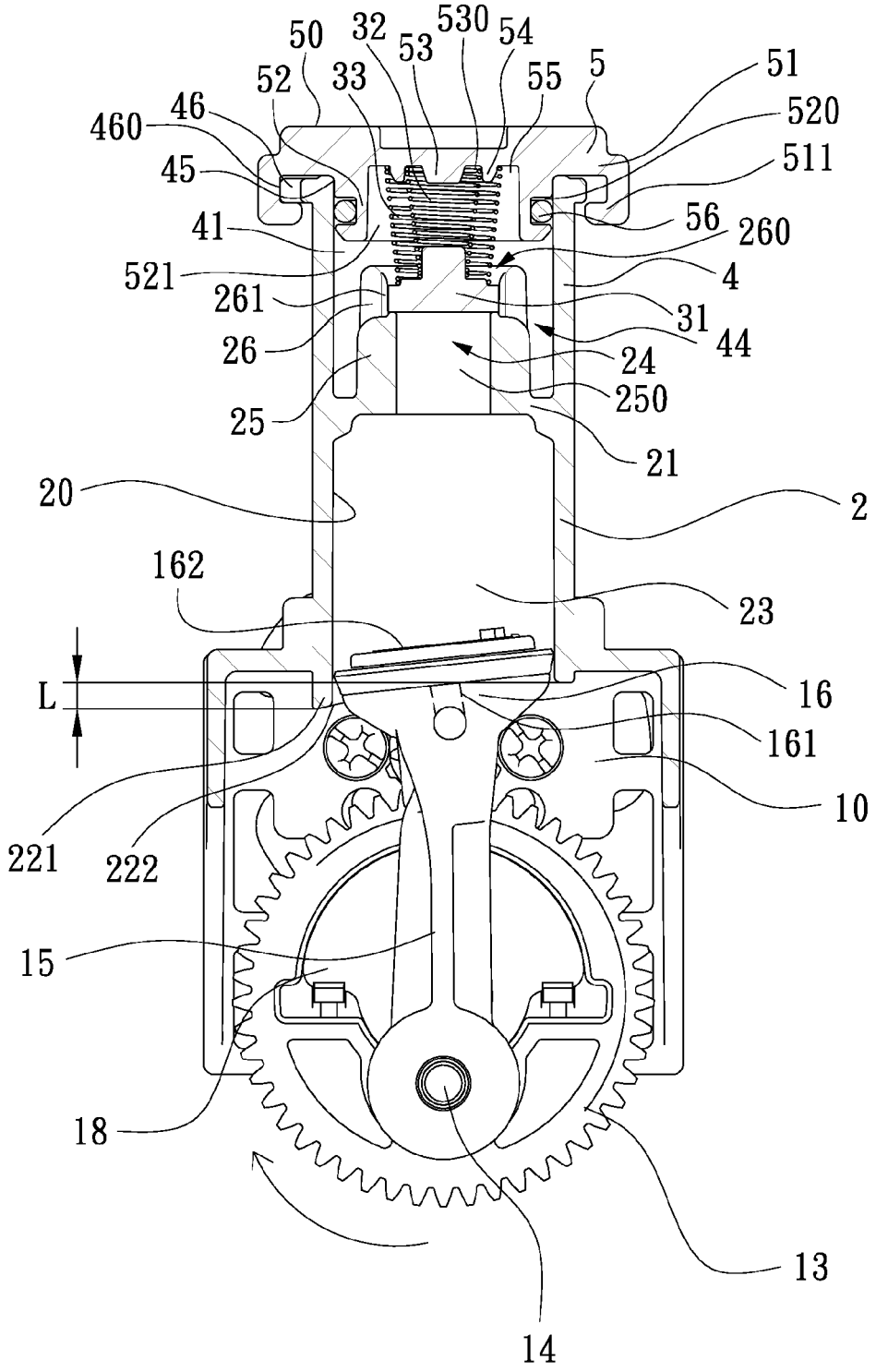
FIG. 5 shows a sectional view of the air compressor of the first embodiment of the present invention.

Referring to FIG. 4, a vertical central line (Y) of the cylinder 2 is used to divide a horizontal line (X) into a positive segment (+X) and a negative segment (−X). As shown, the open bottom 22 of the cylinder 2 is divided into two halves by using the vertical central line (Y) as a dividing line, wherein one half of the open bottom 22 corresponding to the positive segment (+X) is horizontal and parallel to the plane (X-Z) (where Z is an axis perpendicular to both the X-axis and Y-axis), while the other half of the open bottom 22 corresponding to the negative segment (−X) is slanted, and thus an extension portion 221 of the surrounding wall of the cylinder 2, with a slanted bottom 222, is formed. Preferably, the slanted bottom 222 is parallel to the top surface of the piston head 16 when the piston body 15 is at BDC (bottom dead center) or TDC (top dead center). As shown in FIG. 5, the distance between the lowest point of the slanted bottom 222 and the horizontal bottom is indicated by the symbol (L).

Furthermore, the slanting direction of the top surface of the piston head 16 as well as the slanted bottom 222 depends on the rotational direction of the large gear 13. For example, as shown in FIG. 5, when the rotation of the large gear 13 is clockwise and the slanted bottom 222 is at the left side of the cylinder 2, both the top surface of the piston head 16 and the slanted bottom 222 will be slanted up from the left to the right. On the other hand, if the rotation of the large gear 13 is counterclockwise and the slanted bottom 222 is at the right side of the cylinder 2, then both the top surface of the piston head 16 and the slanted bottom 222 will be slanted up from the right to the left.

The storage cylinder 4 has an open top 45. Specifically, the storage cylinder 4 is integrally formed with the cylinder 2, wherein the surrounding wall of the storage cylinder 4 is an extension of the surrounding wall of the cylinder 2. The inner space 41 of the storage cylinder 4 can store the compressed air from the cylinder 2. Furthermore, the open top 45 of the storage cylinder 4 is formed with a coupling means 46 that includes two substantially opposite plates 460 extending outwardly from the surrounding wall of the storage cylinder 4, wherein one side of each plate 460 is formed into a first holding portion 461 defining a first receiving slot 462.

A cover, which is used to seal the open top 45 of the storage cylinder 4, has a base plate 5 and two substantially opposite plates 51 extending outwardly from the base plate 5. One side of each plate 51 of the cover is formed into a second holding portion 511, which is substantially L-shaped and defines a second receiving slot 512. The outer surface of the base plate 5 is provided with radial ribs 50 to facilitate a user to operate the cover. As shown in FIG. 2, the cover is further formed with a tubular connection portion 52 extending downwardly from the inner surface of the base plate 5 (see also FIG. 6). The tubular connection portion 52 defines an annular groove 520 around its circumference to be fitted with a seal ring 56. The inner space 521 of the tubular connection portion 52 constitutes part of the first pressure chamber 44 for storing the compressed air from the cylinder 2. The inner surface of the base plate 5 is formed with a central boss 53 and an annular protrusion 54 around the central boss 53, thus defining an first annular groove 530 between the central boss 53 and the annular protrusion 54 and defining a second annular groove 55 between the annular protrusion 54 and the tubular connection portion 52 for mounting compression springs of different diameters. For example, as shown in FIG. 3, the other end of the compression spring 32 can be fitted around the central boss 53 while urged against the first annular groove 530; the other end of the compression spring 33 can be fitted around the annular protrusion 54 while urged against the second annular groove 55.

In assembling the cover to the storage cylinder 4, as shown in FIGS. 1, 2 and 4, the tubular connection portion 52 of the cover can be inserted into the open top 45 of the storage cylinder 4, and then the cover can be rotated by applying a force to the radial ribs 50 thereof to allow the plates 51 thereof to slide in the first receiving slots 462 of the first holding portions 461 of the storage cylinder 4, and allow the plates 460 of the coupling means 46 of the storage cylinder 4 to slide in the second receiving slots 512 of the cover, so that the cover is detachably mounted to the storage cylinder 4 and thus seals the open top 45 of the storage cylinder 4.

The first pressure chamber 44 includes the inner space 41 of the storage cylinder 4 and the inner space 521 of the tubular connection portion 52 of the cover, both of which communicates with each other.

Referring to FIG. 5, the piston body 15 defines an air channel 161 extending downwardly from the top surface of the cylinder head 16 thereof to the ambient environment, while the top surface of the piston head 16 is attached with a flexible sheet 162 over the channel 161 of the cylinder head 16 so as to control the introduction of ambient air into the inner space 23 of the cylinder 2. Thus, when the piston body 15 conducts a downward motion (intake stroke), due to the pressure within the inner space 23 of the cylinder 2 is less than the ambient pressure, the flexible sheet 162 can be pushed up to allow ambient air to enter the inner space 23 of the cylinder 2; when the piston body 16 conducts an upward motion (compression stroke), due to the pressure within the inner space 23 of the cylinder 2 is more than the ambient pressure, the flexible sheet 262 can be urged to be in flat contact with the top surface of the piston head 16 and thus seal the channel 161 of the piston head 16, so that the compressed air in the inner space 23 of the cylinder 2 is unable to go through the air channel 161 to leak out of the cylinder 2.

The piston body 15 can conduct reciprocating motions within the cylinder 2. In FIG. 5, the piston body 15 is at BDC (bottom dead center) and ready for conducting an upward motion (compression stroke). The upward motion of the piston body 15 enables the compressed air in the inner space 23 of the cylinder 2 to overcome the biasing force of the compression springs 32, 33 and thus the valve plug 31 can be forced to move up, so that the compressed air can flow through the bore 250 of the tubular projection 25 and the gaps 262 between the tabs 26 to enter the first pressure chamber 44 of the storage cylinder 4 (see FIG. 6). By using a hose connected between the connection fitting 42 of the storage cylinder 4 and an application object, such as a tire, to be inflated, the compressed air can be delivered. In FIG. 4, the piston body 15 is as TDC (top dead center) and ready for conducting a downward motion (intake stroke). Upon the piston body 15 having conducted the downward motion, the piston body 15 is at BDC (bottom dead center)(see FIG. 5). At this moment, the top surface of the piston head 16 is parallel to the slanted bottom 222 of the cylinder 2, and the piston head 16 is entirely within the open bottom 22 of the cylinder 2, so that the piston head 16 will not escape from the cylinder 2 and thus can keep gas-tight with the inner surface 20 of the surrounding wall of the cylinder 2, so that the performance of compressing air and the operational security can be increased.

As mentioned above, the bore 250 of the tubular projection 25 can serve as the second pressure chamber 24. When the piston body 15 reaches TDC (top dead center), although the top surface of the piston head 16 is almost in contact with the top wall 21 of the cylinder (see FIG. 3), due to the second pressure chamber 24 providing additional space for the inner space 23 of the cylinder 2 for storing the compressed air, the force required for conducting the upward motion (compression stroke) can be reduced, so that the piston body 15 can conduct the reciprocating motion more smoothly. Besides, the compressed air can be controlled in a safety range of pressure suitable for inflating an object, so that operational security can be increased.

Figure 7:
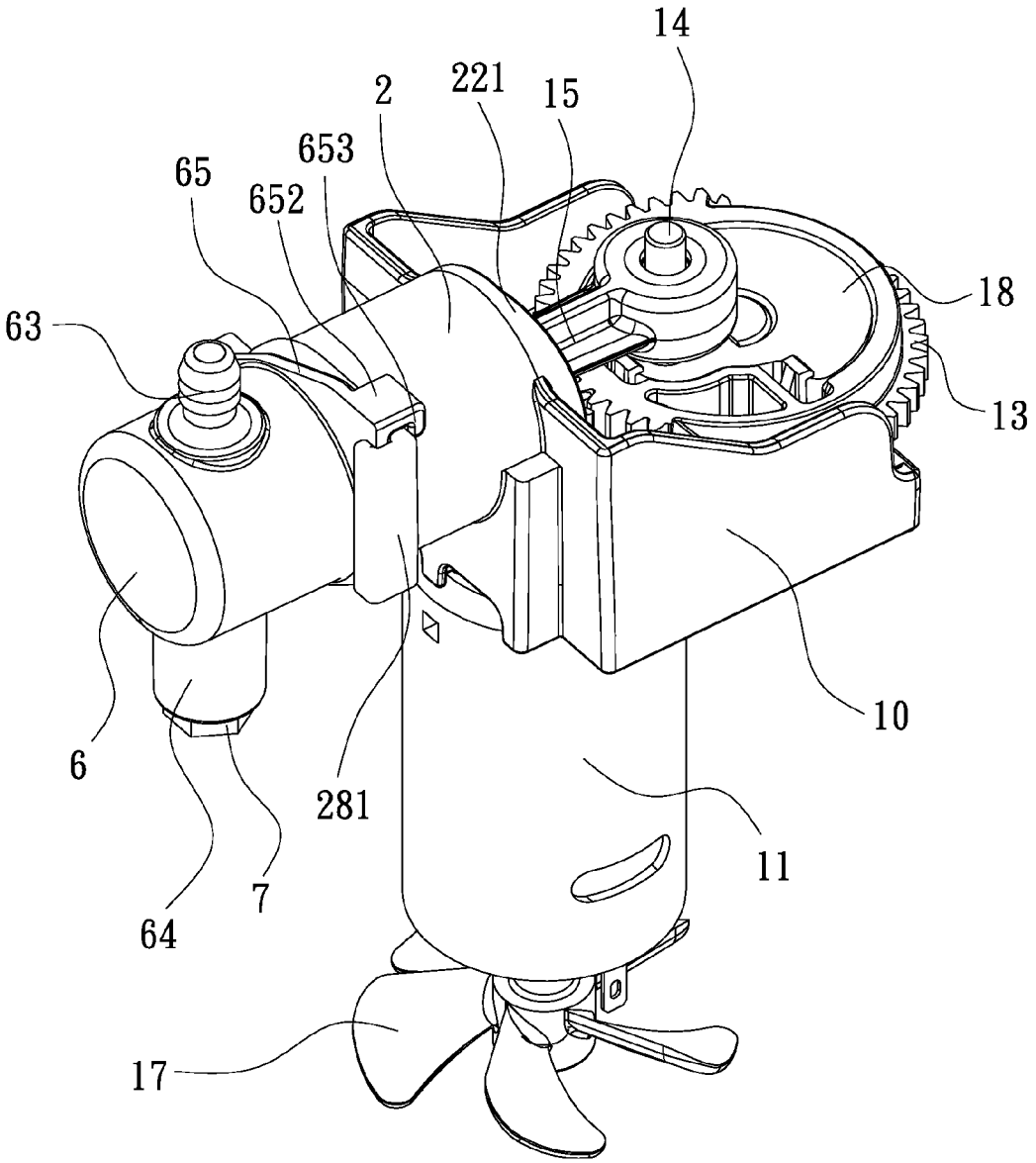
FIG. 7 shows a 3-dimensional view of an air compressor according to a second embodiment of the present invention.
Figure 8:
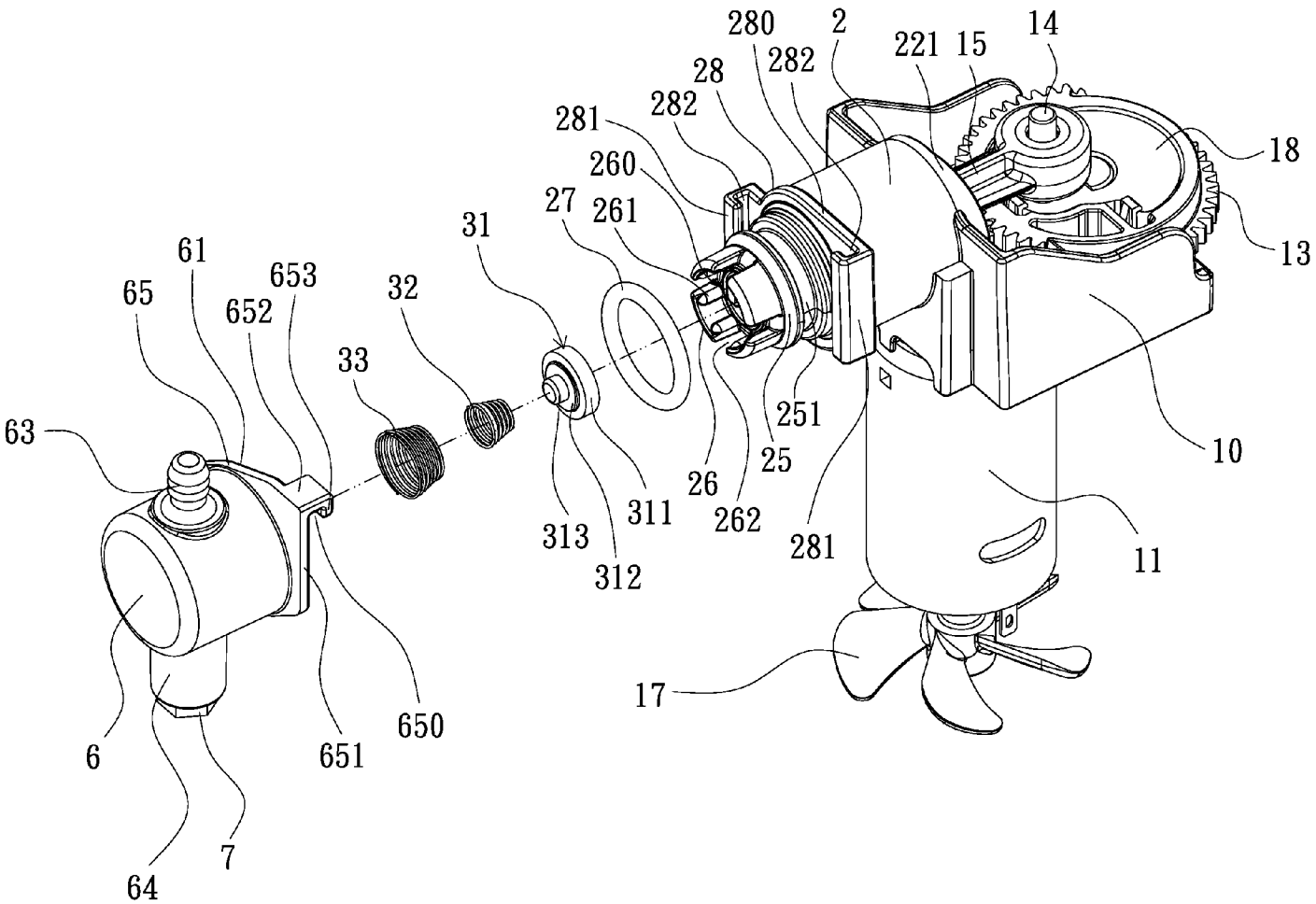
FIG. 8 shows an exploded view of the air compressor of the second embodiment of the present invention.
Figure 9:
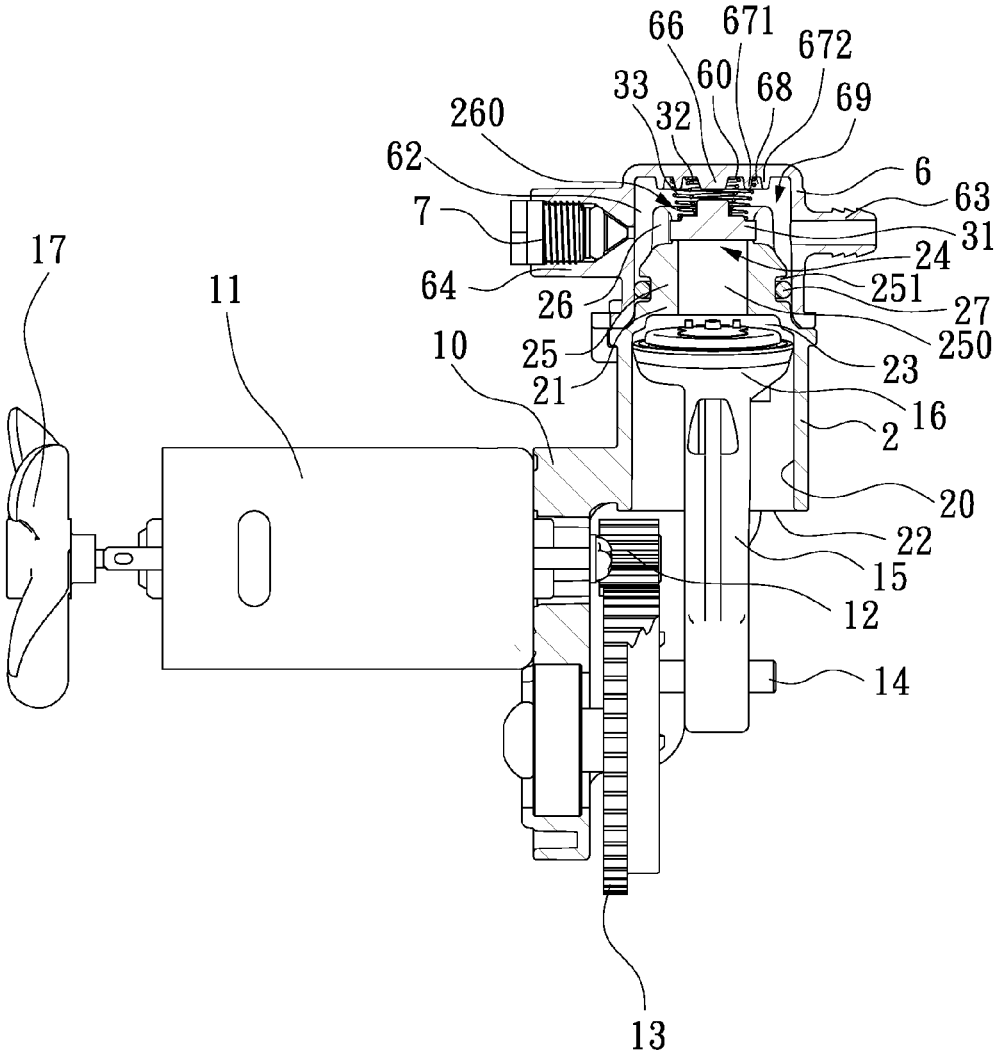
FIG. 9 shows a sectional view of the air compressor of the second embodiment of the present invention.

FIGS. 7 through 11 show a second embodiment of the air compressor of the present invention, wherein the top wall 21 of the cylinder 4 is formed with a first coupling means 28 that includes two substantially opposite plates 280 extending outwardly from the top wall 21 of the cylinder 2. One side of each plate 280 is formed into a first holding portion 281 defining a first receiving slot 282. The tubular projection 25 of the cylinder 2 defines an annular groove 251 around its circumference to be fitted with a seal ring 27. A separate storage cylinder 6, which has a closed top and an open bottom 61 and multiple connection fittings 63, 64, is detachably connected to the cylinder 2. As shown, the open bottom 61 of the storage cylinder 6 is formed with a second coupling means 65 that includes two substantially opposite plates 651 extending outwardly from the surrounding wall of the storage cylinder 6. One side of each plate 651 of the second coupling means 65 of the storage cylinder 6 is formed into a second holding portion defining a second receiving slot 650. Specifically, each second holding portion of the storage cylinder 6 is smaller in width when compared with the first holding portion 281 of the cylinder 2. The second holding portion of the second coupling means 65 of the storage cylinder 6 has a base section 652 and an end section 653 (see FIG. 8), wherein the base section 652 is perpendicular to the corresponding plate 651 of the second coupling means 65 of the storage cylinder 6, the end section 653 is parallel to the correspond plate 651 of the second coupling means 65 of the storage cylinder 6, and the second receiving slot 650 is located between the base section 652 and the end section 653. Furthermore, the inner surface of the closed top of the storage cylinder 6 is formed with a central boss 66, a first annular protrusion 671 around the central boss 66, and a second annular protrusion 672 around the first annular protrusion 671, thus defining an first annular groove 60 between the central boss 66 and the annular protrusion 671 and defining a second annular groove 68 between the first annular protrusion 671 and the second annular protrusion 672 for mounting springs of different diameters. For example, as shown in FIG. 9, the other end of the compression spring 32 can be fitted around the central boss 66 while urged against the first annular groove 60, and the compression spring 33 can be fitted around the first annular protrusion 671 while urged against the second annular groove 68. The inner space 62 of the storage cylinder 6 constitutes the first pressure chamber 69.

Figure 10:
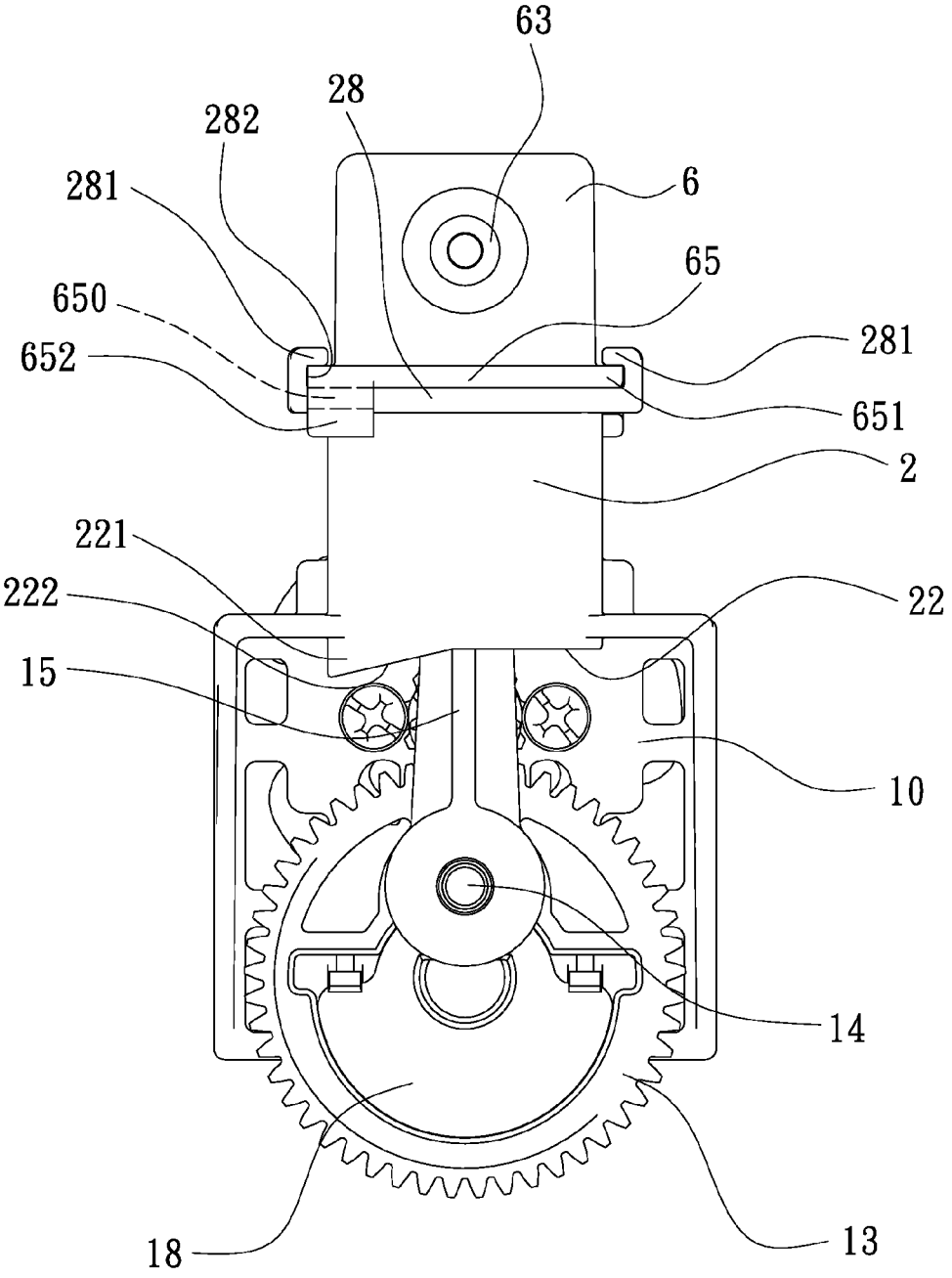
FIG. 10 shows a front view of the air compressor of the second embodiment of the present invention.
Figure 11:
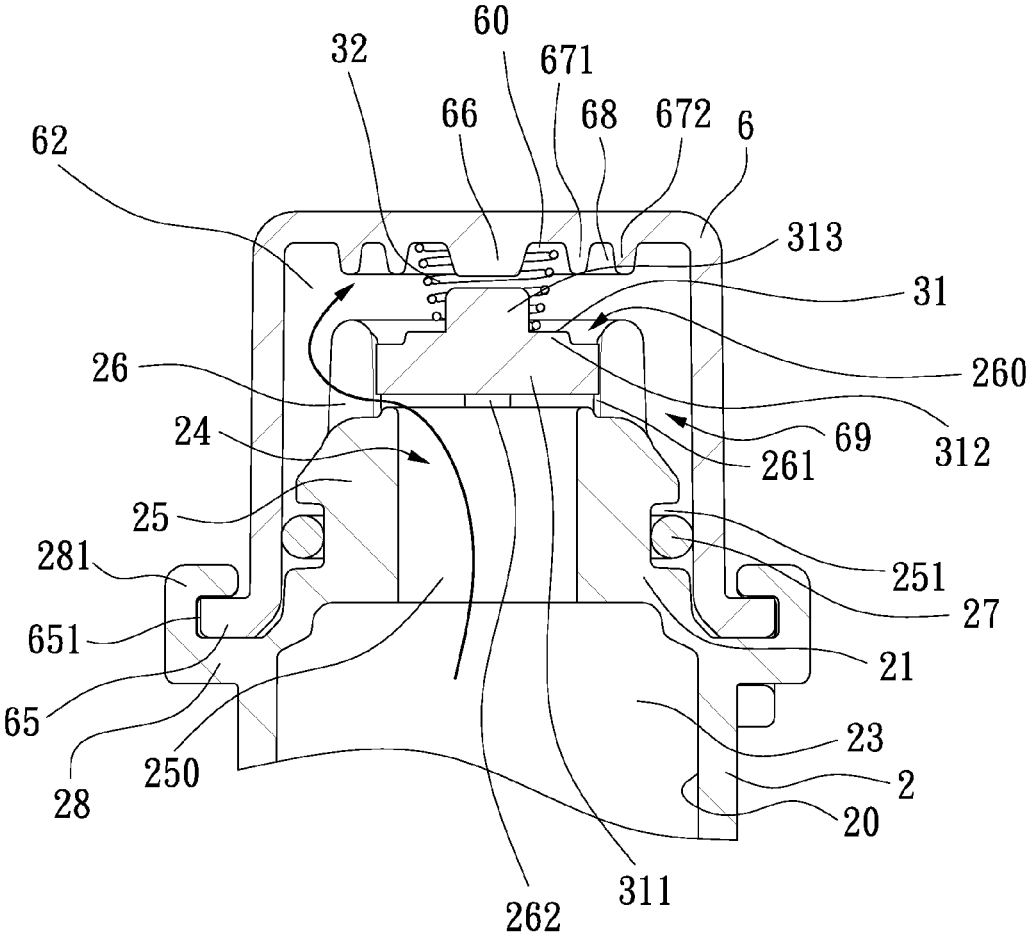
FIG. 11 shows an enlarged partial view of the air compressor of the second embodiment of the present invention, wherein only one compression spring is installed.

In assembling the separate storage cylinder 6 to the cylinder 2, as shown in FIGS. 7, 8 and 10, the separate storage cylinder 6 can be fitted over the tubular projection 25 of the cylinder 2, and then the storage cylinder 6 can be rotated to allow the plates 651 of the second coupling means 65 of the storage cylinder 6 to slide in the first receiving slots 282 of the first coupling means 28 of the cylinder 2 and allow the plates 280 of the first coupling means 28 of the storage cylinder 2 to slide in the second receiving slots 650 of the second coupling means 65 of the storage cylinder 6, so that the first holding portion 281 of the first coupling means 28 and the base section 652 of the second coupling means 65 are mutually blocked, and thus the storage cylinder 6 is detachably mounted to the cylinder 2 and thus seals the tubular projection 25 of the cylinder 2.

As a summary, one feature of the present invention is that the bore 250 of the tubular projection 25 formed on the top wall 21 of the cylinder 2 can serve as a second pressure chamber in addition to the first pressure chamber 44, 69. Thus, when the piston body 15 reaches TDC (top dead center), although the top surface of the piston head 16 is almost in contact with the top wall 21 of the cylinder 2 (see FIG. 3), due to the second pressure chamber 24 (i.e., the bore 250 of the tubular projection 25) providing additional space for the inner space 23 of the cylinder 2 for storing compressed air, the force required for conducting the upward motion (compression stroke) can be reduced, and thus the piston body 15 can conduct reciprocating motion more smoothly. Besides, the compressed air can be controlled in a safety range of pressure suitable for inflating an object, so that operational security can be increased. Furthermore, the open bottom 22 of the cylinder 2 can be divided into two parts by using a vertical central line (Y) of the cylinder 2 as a dividing line, wherein one half of the open bottom 22 corresponding to the negative segment (−X) is slanted, and thus an extension portion 221 of the surrounding wall of the cylinder 2, with a slanted bottom 222, is formed. When the piston body 15 is at BDC (bottom dead center), the top surface of the piston head 16 is parallel to the slanted bottom 222 of the cylinder 2. As such, the piston head 16 is entirely within the open bottom 22 of the cylinder 2, so that the piston head 16 will not escape from the cylinder 2 and thus can keep gas-tight with the inner surface 20 of the surrounding wall of the cylinder 2, so that the performance of compressing air and the operational security can be increased.

I claim:

1. An improved air compressor including a main housing, a cylinder fitted with a piston body having a piston head, an air storage unit defining a first pressure chamber communicating with the cylinder, a motor fitted with a small gear at an axle thereof, and a large gear, the motor and the large gear are mounted to the main housing such that the small gear engages with the large gear, the large gear is provided with a counterweight being fixed with a crankpin, the piston body is pivotally mounted to the crankpin, the motor drives the crankpin to swing in a circle, which allows the piston body to conduct reciprocating motion within the cylinder so as to force the compressed air in the inner space of the cylinder to flow into the air storage unit; wherein the improvement comprises: said main housing is formed integrally with the cylinder, and said cylinder defines at its top a second pressure chamber that communicates with the inner space thereof, and a valve plug is provided between the cylinder and the air storage unit for controlling the air communication between the first pressure chamber of the air storage unit and the second pressure chamber of the cylinder, wherein the cylinder has a top wall and an open bottom, a tubular projection being formed on the top wall of the cylinder, the bore of the tubular projection communicating with the inner space of the cylinder, the top of the tubular projection being provided with multiple tabs at regular gaps to define a central space there between, the inner surface of each tab being provided with multiple spaced ribs; further wherein the valve plug has a bottom round portion, a middle round portion, and a top round portion, the bottom portion having a diameter greater than the middle portion, the middle round portion having a diameter greater than the top portion, the valve plug being located in the central space surrounded by the tabs and snugly fitted between the ribs so as to prevent the valve plug from lateral movement under a force, the diameter of the bottom portion being smaller than the diameter of the central space surrounded by the tabs but greater than the diameter of the bore of the tubular projection; and further wherein at least one spring is disposed between the air storage unit and the valve plug, one end of the spring being fitted around the top round portion of the valve plug while urged against the middle round portion or fitted around the middle round portion of the valve plug while urged against the bottom round portion, whereby the compressed air in the inner space of the cylinder will be controlled at a predetermined pressure to enter the first pressure chamber of the air storage unit by way of the gaps between the tabs.

2. The improved air compressor of claim 1, wherein the length of the bore of the tubular projection is greater than the height of the valve plug, and the bore serves as the second pressure chamber of the cylinder; whereby the bore of the tubular projection is able to buffer the pressure of the compressed air in the inner space of the cylinder and thus reduce the force required for the piston body to conduct a compression stroke, thereby allowing the piston body to move more smoothly within the cylinder and preventing the application objects using the compressed air from being damaged.

3. The improved air compressor of claim 2, wherein the top surface of the piston head is configured with a slope so as to reduce the force required for moving the piston body at BDC or MC, and increase the gas-tightness of the cylinder after the piston body passes BDC or TDC, so that the piston body will conduct reciprocating motion more smoothly and the performance of compressing air will be increased.

4. The improved air compressor of claim 3, wherein the open bottom of the cylinder is divided into two halves according to a central vertical line of the cylinder, one half of the open bottom being horizontal while the other half of the open bottom being slanted and parallel to the top surface of the piston head when the piston body is at BDC, whereby when the piston body is at BDC, the piston head will be entirely within the open bottom of the cylinder and thus will not escape from the cylinder, so that the operational security will be increased and the piston head will keep gas-tight with the inner surface of the surrounding wall of the cylinder, thereby increasing the performance of compressing air.

5. The improved air compressor of claim 4, wherein the air storage unit includes a cover and a storage cylinder with an open top, the storage cylinder being integrally formed with the cylinder, wherein the surrounding wall of the storage cylinder is an extension of the surrounding wall of the cylinder, the storage cylinder is provided with at least one connection fitting, from which the compressed air can be delivered, the inner space of the storage cylinder constitutes part of the first pressure chamber and communicates with the inner space of the cylinder via the bore of the tubular projection, the cover is detachably connected to the open top of the storage cylinder, and the spring is disposed between the cover and the valve plug.

6. The improved air compressor of claim 5, wherein the open top of the storage cylinder is formed with a coupling means that includes two substantially opposite plates extending outwardly from the surrounding wall of the storage cylinder, one side of each plate being formed into a first holding portion defining a first receiving slot; further wherein the cover has a base plate and two substantially opposite plates extending outwardly from the base plate, one side of each plate of the cover being formed into a second holding portion defining a second receiving slot, the outer surface of the base plate being provided with radial ribs to facilitate a user to operate the cover, the cover being further formed with a tubular connection portion extending downwardly from the inner surface of the base plate, the tubular connection portion defining an annular groove around its circumference to be fitted with a seal ring, the inner space of the tubular connection portion constituting part of the first pressure chamber, the inner surface of the base plate being formed with a central boss and an annular protrusion around the central boss, thus defining an first annular groove between the central boss and the annular protrusion and defining a second annular groove between the annular protrusion and the tubular connection portion; and further wherein the other end of the spring is fitted around the central boss while urged against the first annular groove or fitted around the annular protrusion while urged against the second annular groove; whereby the tubular connection portion of the cover is capable of being inserted into the storage cylinder, and the cover is capable of being rotated to allow the plates of the cover to slide in the first receiving slots of the storage cylinder, and allow the plates of the storage cylinder to slide in the second receiving slots of the cover, so that the cover is detachably mounted to the storage cylinder and thus seals the open top of the storage cylinder.

7. The improved air compressor of claim 6, wherein the first pressure chamber includes the inner space of the storage cylinder and the inner space of the cover, both of which communicates with each other.

8. The improved air compressor of claim 4, wherein the air storage unit is a separate storage cylinder, which is detachably mounted over the tubular projection formed integrally with the cylinder, wherein the separate storage cylinder has a closed top and an open bottom and is provided with at least one connection fitting, from which the compressed air can be delivered, the spring is disposed between the separate storage cylinder and the valve plug, and the inner space of the separate storage cylinder is communicable with the bore of the tubular projection.

9. The improved air compressor of claim 8, wherein the top wall of the cylinder is formed with a first coupling means that includes two substantially opposite plates extending outwardly from the top wall of the cylinder, one side of each plate being formed into a first holding portion defining a first receiving slot, the tubular projection of the cylinder defining an annular groove around its circumference to be fitted with a seal ring; and further wherein the open bottom of the storage cylinder is formed with a second coupling means that includes two substantially opposite plates extending outwardly from the surrounding wall of the storage cylinder, one side of each plate of the storage cylinder being formed into a second holding portion defining a second receiving slot, the inner space of the storage cylinder constituting the first pressure chamber; whereby the storage cylinder is capable of being fitted over the tubular projection of the cylinder, and is capable of being rotated to allow the plates thereof to slide in the first receiving slots of the storage cylinder and allow the plates of the storage cylinder to slide in the second receiving slots thereof, so that the separate storage cylinder is detachably mounted to the cylinder and thus seals the tubular projection of the cylinder.

10. The improved air compressor of claim 9, wherein each second holding portion of the separate storage cylinder is smaller in width when compared with the first holding portion of the cylinder, the second holding portion of the storage cylinder has a base section and an end section, the base section being perpendicular to the corresponding plate of the storage cylinder, the end section being parallel to the correspond plate of the storage cylinder, the second receiving slots being located between the base section and the end section.

11. The improved air compressor of claim 9, wherein the inner surface of the closed top of the storage cylinder is formed with a central boss, a first annular protrusion around the central boss, and a second annular protrusion around the first annular protrusion, thus defining an first annular groove between the central boss and the annular protrusion and defining a second annular groove between the first annular protrusion and the second annular protrusion; and further wherein the other end of the spring is fitted around the central boss while urged against the first annular groove or fitted around the first annular protrusion while urged against the second annular groove.

12. The improved air compressor of claim 3, wherein the piston body defines an air channel extending from the top surface of the cylinder head to the ambient environment, and the top surface of the piston head is attached with a flexible sheet so as to control the introduction of ambient air into the inner space of the cylinder.

* * * * *